US007581365B2

(12) United States Patent
White et al.

(10) Patent No.: US 7,581,365 B2
(45) Date of Patent: Sep. 1, 2009

(54) WALL-TIE-ENGAGING SHEATHING-RETAINING DEVICE

(75) Inventors: James P. White, Muskego, WI (US); Earl D. Meinen, Muskego, WI (US)

(73) Assignee: Wisconsin Poured Wall Products, Muskego, WI (US)

( * ) Notice: Subject to any disclaimer, the term of this patent is extended or adjusted under 35 U.S.C. 154(b) by 0 days.

(21) Appl. No.: 10/301,962

(22) Filed: Nov. 22, 2002

(65) Prior Publication Data

US 2004/0107658 A1 Jun. 10, 2004

(51) Int. Cl.
*E04B 1/00* (2006.01)

(52) U.S. Cl. ..... 52/745.21; 52/506.05

(58) Field of Classification Search ..... 52/309.11, 52/426, 309.8, 309.12, 309.17, 408, 410, 52/745.21, 746.1, 301, 449, 565, 506.05, 52/511, 404.2, 506.02, 745.13, 745.09; 411/338, 411/339, 512, 525, 526, 527; 24/102 T, 104, 24/108, 30.5 P
See application file for complete search history.

(56) References Cited

U.S. PATENT DOCUMENTS

| | | | | | |
|---|---|---|---|---|---|
| 492,518 | A * | 2/1893 | Gholson | 52/301 |
| 3,967,524 | A * | 7/1976 | Snow et al. | 441/461 |
| 4,239,173 | A * | 12/1980 | Sawyer | 249/41 |
| 4,432,289 | A * | 2/1984 | Norman et al. | 110/336 |
| 4,653,241 | A * | 3/1987 | Bindi | 52/169.11 |
| 5,409,193 | A | 4/1995 | Baxter | |
| 5,497,592 | A * | 3/1996 | Boeshart | 52/699 |
| 5,582,388 | A | 12/1996 | Baxter | |
| 5,692,356 | A | 12/1997 | Baxter | |
| 5,744,076 | A | 4/1998 | Baxter | |
| 5,809,725 | A * | 9/1998 | Cretti | 52/426 |
| 5,895,188 | A * | 4/1999 | Cheng | 411/433 |
| 5,987,830 | A | 11/1999 | Worley | |
| 6,287,064 | B1 * | 9/2001 | Jhumra et al. | 411/175 |
| 6,434,902 | B1 * | 8/2002 | Westra | 52/309.17 |
| 6,514,005 | B2 * | 2/2003 | Shiokawa et al. | 403/408.1 |
| 6,898,912 | B2 * | 5/2005 | Bravinski | 52/426 |
| 2004/0011943 | A1 * | 1/2004 | Long, Sr. | 249/216 |

FOREIGN PATENT DOCUMENTS

DE 2703665 A1 * 3/1978

* cited by examiner

*Primary Examiner*—A. Joseph Wujciak, III
(74) *Attorney, Agent, or Firm*—Jansson Shupe & Munger Ltd.

(57) ABSTRACT

A sheathing-retention device, for securing sheathing against a wall having at least one protruding wall-tie with a substantially rectangular cross-sectional profile, includes a sheathing-retention device having a sheathing-engagement surface for abutting an exterior surface of the sheathing, and a press-fit type tie holder portion with a channel orthogonally formed with respect to the sheathing-engagement surface, the channel having a substantially rectangular cross-sectional profile approximating that of the wall tie and being dimensionally adapted for snugly fitting around the wall-tie when the sheathing-retention device is urged onto the wall-tie by having at least a portion of the channel with cross-sectional dimensions less than rectangular dimensions of the wall-tie cross-section, the channel extending through both the sheathing-supporting portion and the press-fit type tie holder portion.

14 Claims, 4 Drawing Sheets

WALL-TIE-ENGAGING SHEATHING-RETAINING DEVICE

FIELD OF THE INVENTION

This invention is related generally to insulation sheathing and, more particularly, to devices and methods for retaining insulating sheathing to the foundation of a building.

BACKGROUND OF THE INVENTION

Installing insulation against the walls and foundations of building structures is well known in the art. Insulation is used to hold heat within a building thereby making heating systems more efficient while at the same time preventing moisture from damaging the walls of a structure. In many communities, below-grade insulation is required by local building code.

At present, prior to pouring concrete walls, vertical forms, most typically comprised of plywood sheets, are positioned in parallel, opposing pairs to form an interior cavity into which the fluid concrete is poured. The forms are held in the fixed vertical orientation during the pouring process by form ties, which are most typically of metal. These ties extend between the forms within the interior cavity and then through each of the forms to the exterior of the forms where a cross-member is placed into the tie to prevent the forms from moving outwardly. Once a poured-concrete wall has cured sufficiently, the forms are removed, leaving embedded within the wall, metal wall ties. In present usage, the portion of the wall ties extending out from the surface of the wall presents a surface discontinuity which makes the flush installation of a sheet of insulation to the wall surface impossible. The portion of the tie extending out from the wall must be removed. The removal is accomplished by a general laborer using a tool specially designed for removal of the tie. The tool is slid over the tie to a point where the tool envelopes the entire portion of the tie to be removed, then the tool is rotated snapping the metal tie nearly flush with the surface of the wall. This procedure is carried out one tie at a time, one side at a time. The removal process thus results in the incurrence of capital expenses for the tool and labor costs for its use.

After removal of the exposed portions of the ties, sheathing in the form of sheets of insulation is positioned against the relatively smooth walls. Most of the insulation and the portion of the wall to which the insulation is attached is then buried in a backfill operation. To hold the sheathing in place during the backfill operation, prior to backfilling, metal tacks or bolts are shot through the sheathing into the concrete by means of an explosive-charge delivered by a specially designed gun. The tacking operation involves additional costs for materials and labor. Moreover, the existing method involves safety risks through malfunction or improper use of the explosive-charge gun, and through the creation of shards as the metal contacts the hardened concrete.

A device and method for applying and retaining insulating sheathing to a poured concrete wall without the need to remove the ties originally imbedded in the wall and without the need to drive metal pieces into hardened concrete, would be an important improvement in the art.

OBJECTS OF THE INVENTION

It is an object of the invention to provide a device and method for retaining insulating sheathing to foundation walls that overcomes some of the shortcomings of the prior art.

It is another object of the invention to provide a device and method for using the wall ties for sheath retention.

Still another object of the invention is to provide a device and method for obviating the need to remove wall ties from a cured poured wall.

Another object of the invention is to provide a device and method for reducing construction labor costs by obviating the need to remove the wall ties.

It is still another object of the invention to reduce the construction labor and material costs by obviating the need to install another retention means into the hardened, poured-concrete wall.

Yet another object of the invention is to provide a device and method for covering the ends of wall ties extending from a poured-concrete wall in order to help protect construction workers from injury therefrom prior to a backfilling operation.

How these and other objects are accomplished will become apparent from the following descriptions and from the drawings.

SUMMARY OF THE INVENTION

The invention involves a sheathing-retention device for supporting sheathing against a surface. The sheathing-retention device has a rigid sheathing-engagement portion having an outer surface and an inner surface; and has a tie-engagement portion located with respect to the inner surface. In this way, an end of a wall-tie extending out from the surface (e.g., of a wall) may be received and engaged by the tie-engagement portion while at the same time, the sheathing-engagement portion is in contact with the sheathing, holding the sheathing against the surface (e.g., of the wall). It is preferred that the sheathing-engagement portion is substantially plate-like.

In another embodiment, the tie-engagement portion is at least two prongs extending from the inner surface, configured and arranged to engage the wall-tie between the at least two prongs. In a different embodiment, the tie-engagement portion is a sleeve extending from the inner surface. In this latter embodiment, the sleeve has a concave interior space, into which the wall-tie is engaged.

In a still different embodiment, the sheathing-engaging portion has an aperture extending through it to the outer surface thereby creating the tie-engagement portion. It is more preferable in this embodiment for the tie-engagement portion to comprise a sleeve extending from the inner surface of the sheathing-attachment portion surrounding the aperture and extending from the aperture; in this way, the aperture stems through the sleeve to the outer surface. It is yet more preferable in this embodiment for the sleeve to have a distal port of a first aperture-cross-sectional area and a proximal port, proximate to the sheathing-engagement portion, of a second aperture-cross-sectional area smaller than the first aperture-cross-sectional area. There is a taper of the aperture from the distal port to the proximal port of the sleeve whereby the end of the wall-tie may be easily inserted into the distal port to a point within the aperture of the sleeve. Due to the taper, the wall-tie will snugly engage the sheathing-retention device.

It is preferable in this embodiment for the inner surface of the sheathing-engagement portion to substantially surround the sleeve and to be of a shape complementary to the a surface of the sheathing with which it will be in contact when the sheathing-retention device is in snug engagement with the wall-tie. It is more preferable for the sheathing-retention device to have the outer surface of the sheathing-engagement portion flat. It is yet more preferable if the outer surface of the sheathing-engagement portion is suited to be struck with a blunt object, such as a hammer, in order to urge the sheathing-retention device into snug engagement with the wall-tie.

In the embodiment in which the sleeve has a distal port of a first aperture-cross-sectional area and a proximal port, proximate to the sheathing-engagement portion, of a second aperture-cross-sectional area smaller than the first aperture-cross-sectional area, it is more preferable when the second aperture-cross-sectional area has a shape generally conforming to the cross-sectional shape of the end of the wall-tie and has dimensions generally no larger than the cross-sectional area of a portion of the wall-tie remote from the end, and the outer surface of the sheathing-engagement portion is suited to engage the sheathing. In this way, the end of the wall-tie may be urged into the proximal port of the sleeve into snug engagement with the sheathing-retention device. It is yet more preferable for the distal end of the sleeve to be suited to be struck with a blunt object in order to urge the sheathing-retention device into snug engagement with the wall-tie.

Another aspect of this invention is a method for affixing a panel to a masonry wall having an exterior surface and a wall-tie protruding from the exterior surface. The method includes the steps of: (a) pushing the panel toward the exterior surface, thereby causing the wall-tie to penetrate the panel; (b) providing a sheathing-retention device having a tie-engagement portion and a panel-retention portion; and (c) urging the tie-engagement portion into engagement with and along the wall-tie toward the exterior surface of the wall, thereby affixing the panel to the wall.

In one embodiment of the method, the tie-engagement portion includes an aperture having a shape generally conforming to the cross-sectional shape of the wall-tie, thereby causing frictional engagement of the tie-engagement portion with the wall-tie. It is preferable in this embodiment for the urging step to include urging the panel-retention portion into frictional engagement with the wall-tie.

In another embodiment of the method, the urging step includes urging the panel-retention portion against the panel.

A third aspect of the invention, involves a poured-concrete wall having (a) an exterior surface and (b) at least one wall-tie imbedded in and extending out from the exterior surface. The improvement comprises: an insulating panel against the exterior surface and impaled on the at least one wall-tie; and a panel-mounting member frictionally engaging the at least one wall-tie and abutting the panel. In this way, the panel is secured to the wall.

In one embodiment of this aspect, the panel-mounting member is dimensioned to fully obscure the at least one wall-tie.

In another embodiment of this aspect, the panel-mounting member is configured to present a profile substantially flush with an outer surface of the panel when the panel-mounting member is frictionally engaged with the at least one wall-tie.

BRIEF DESCRIPTION OF THE DRAWINGS

The drawings illustrate preferred embodiments which include the above-noted characteristics and features of the invention. The invention will be readily understood from the descriptions and drawings. In the drawings.

DETAILED DESCRIPTION OF PREFERRED EMBODIMENTS

Figure 7:
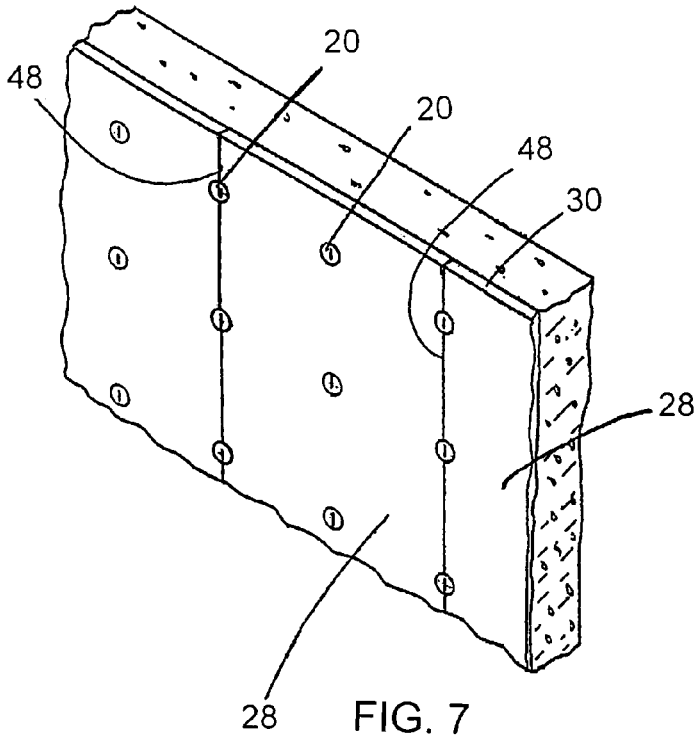
FIG. 7 is a perspective view of a wall section with insulation held in place by the sheath-retaining device.

FIGS. 1-5 show a preferred embodiment of the sheath-retaining device 20. The back of device 20 consists of a plate-like sheathing-engaging portion 22. The sheathing-engaging portion 22 has a front face 24 and a back face 26. Each face 24, 26 is flat to maximize the surface engagement interface between the particular face 24, 26 and the outer surface 28 of the sheet of insulation 30 (seen in FIG. 7).

Figure 6:
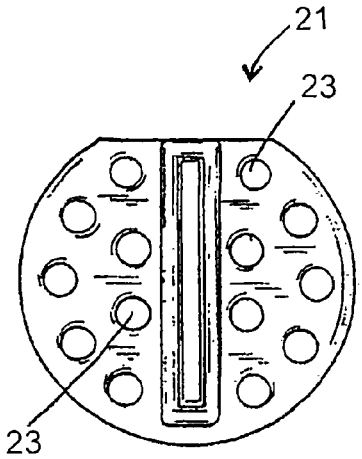
FIG. 6 is a front view of an alternate embodiment of the sheath-retaining device.

The functionality of the device is not dependent on the shape of the sheathing-engaging portion 22. For purposes of illustration, the shape depicted is a substantially circular disk. It has been found that the one (1) inch radius circular sheathing-retention portion 22, providing approximately three (3) square inches of interface surface area is a satisfactory balance between providing sufficient surface interface and minimizing material cost per unit. Yet, as seen in FIG. 6, the functioning of a device 21 is not encumbered by the removal of material to create a series of holes 23, thereby reducing the amount of material used.

Returning to FIGS. 1-5, extending out from the front face 24 is a tie-engaging portion 32. The tie-engaging portion 32 must be capable of holding the sheathing-engaging portion 22 to a wall tie 42. As such is the case, the tie engaging portion 32 can be a simple two prongs of resilient material dimensioned to hold the wall tie 42 between them. Nonetheless, it is desirable to maintain a tight grip on wall tie 42 and hence the preferred embodiment depicted seeks to maximize the tie-engaging surface.

The tie-engaging portion 32 has a length dimension measured out from the front face 24 along the tie-engaging portion 32. It is desirable to have the length of the tie-engaging portion 32 no greater than the width of a sheet of insulation 30. Toward that end, a preferred embodiment of the device 20 to accommodate a majority of sheathing, has a tie-engaging-portion length of no greater than three-quarters (¾) of an inch.

Figure 10:
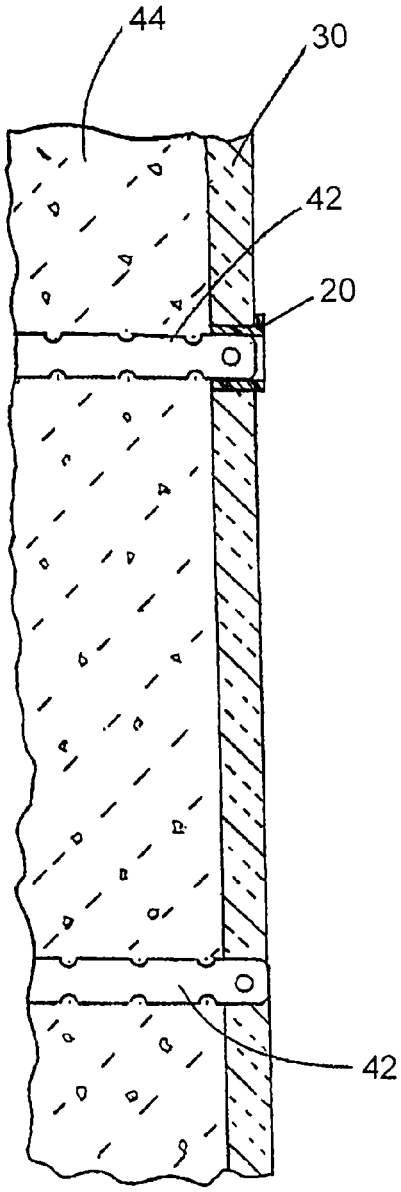
FIG. 10 is a partial cross-sectional side view of a masonry wall with a wall tie, sheathed with insulation.
Figure 11:
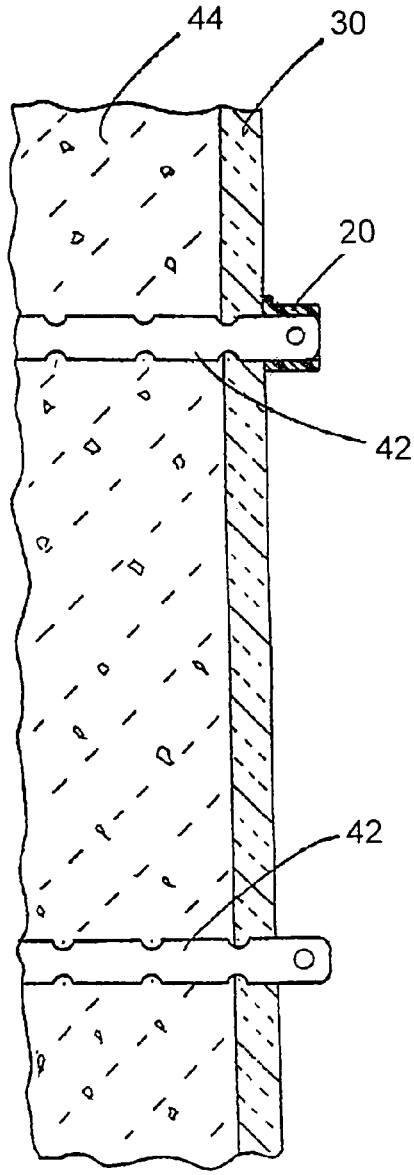
FIG. 11 is a partial cross-sectional side view of a masonry wall with a wall tie of a longer length than the wall tie of FIG. 10, sheathed with insulation.

This particular embodiment described is ambidextrous in that a wall tie 42 may engage the device 20 through either the front port 36 as seen in FIG. 10 or by insertion into the back port 38 as shown in FIG. 11. Although the particular embodiment described is ambidextrous, it is expected that the most common use of the device 20 will be in applications where insertion of the wall tie 42 is through the front port 36.

In addition to being ambidextrous the embodiment depicted in FIGS. 1-5 is versatile.

Figure 4:
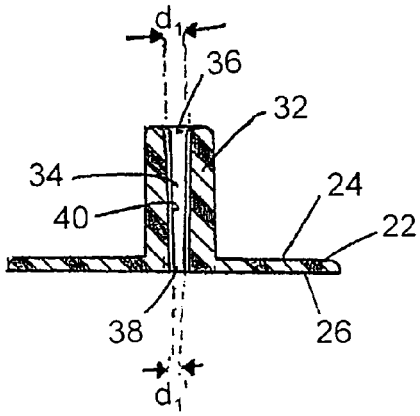
FIG. 4 is a cross-sectional view of the device of FIG. 2 taken along the lines 4-4.

The tie-engaging portion 32 defines a channel 34 through the device 20. As seen in FIG. 4, channel 34 includes a front port 36 and a back port 38. The longitudinal inner surface 40 of the channel 34 is tapered from the front port 36 to the back port 38. The purpose of the taper is to facilitate engagement with a wall tie 42 (shown in FIGS. 8-11).

Wall ties 42 are typically made of metal for strength. Wall ties 42 are slab-like with a length, width, and depth (the smallest dimension). The wall ties 42 in current use, regardless of length, typically fall into either of two dimensional styles: wall ties of the first style are of a width of three-quarters (¾) of an inch and of depth of approximately one-eighth (⅛) of an inch, while wall ties of the second style have a width of approximately one and one-half (1½) inches and a depth of approximately three thirty-seconds (3/32) of an inch.

Figure 1:
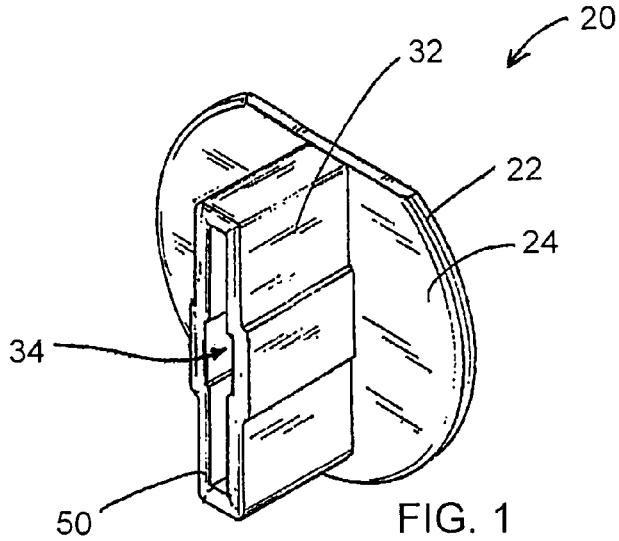
FIG. 1 is a perspective view of the sheath-retaining device of this invention.
Figure 2:
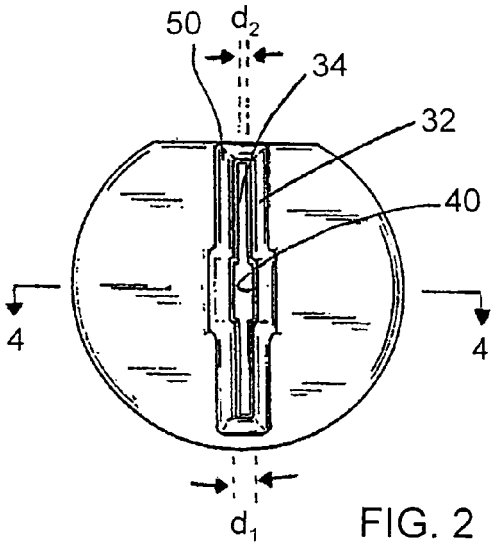
FIG. 2 is a face view of the sheath-retaining device of this invention.
Figure 3:
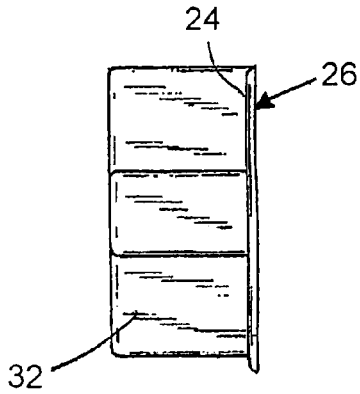
FIG. 3 is a side view of the sheath-retaining device.
Figure 5:
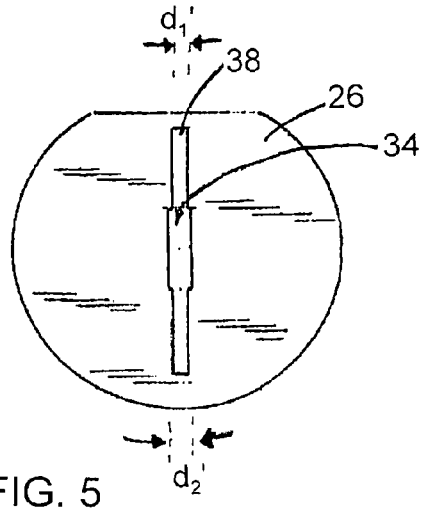
FIG. 5 is a back view of the sheath-retaining device.
Figure 12:
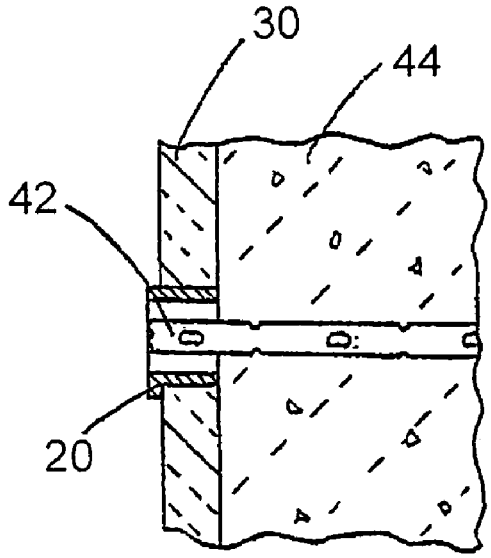
FIG. 12 is a partial cross-sectional side view of a masonry wall with a wall tie of a narrower width than the wall tie of FIG. 10, sheathed with insulation.

The channel 34 is dimensioned to receive the wall tie 42. As shown in FIG. 4, the two-dimensional opening of the front port 36 has a width extending longitudinally and a smaller depth dimension extending laterally across the port. As seen in FIGS. 1, 2, and 5, the front port 36 has a front-port shape with an enwidened central portion having a first depth d1, and with narrower exterior portions on the longitudinal extremes with a second depth d2. Having a front-port shape with two depth dimensions d1, d2 the versatile device 20 may be installed as shown in FIG. 12 with the narrower wall tie 42 of the first depth or as shown in FIG. 10 with the wider wall tie 42 of the second depth.

Correspondingly, the back port 38 has a back-port shape similar to the front-port shape with an enwidened central portion having a first depth d1', and with narrower exterior portions on the longitudinal extremes with a second depth d2'.

The dimensions d1, d2 are greater than the dimensions d1', d2', respectively, to provide a taper along the interior walls 40 of the channel 34. The taper is dimensioned such that d1 is greater than the depth of the wall tie 42 of the first type, while d1' is slightly less than the depth of the same wall tie 42 such that when the protruding end of the wall tie 42 is inserted into the front port 36 of the device 20, and the device 20 is urged onto the wall tie 42 by pressure applied to the back face 26 (for instance, with a strike from a hammer 46), until the front face 24 engages the outer surface 28 of the sheet of insulation 30. The back port 38 with dimension d1', will snugly and frictionally engage the wall tie 42 resisting dislodgement.

In a similar manner, d2 is greater than the depth of the wall tie 42 of the second type while d2' is slightly less than the depth of the same wall tie 42.

Alternatively, the protruding end of the wall tie 42 may be inserted into the back port 38 of the device 20. When used in this orientation, the device 20 is urged onto the wall tie 42 by pressure applied to the front port frame 50 (shown in FIGS. 1 and 2) until the back face 26 engages the outer surface 28 of the sheet of insulation 30. The portion of the channel 34 adjacent to the back port 38 with dimension d1', will snugly and frictionally engage the wall tie 42 resisting dislodgement.

Figure 8:
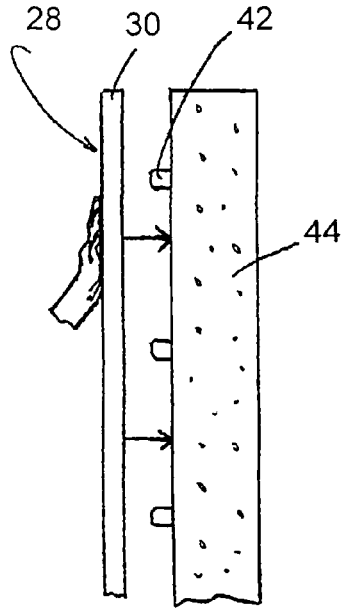
FIG. 8 is a side sectional view of a cured masonry wall with form ties extending out therefrom.
Figure 9:
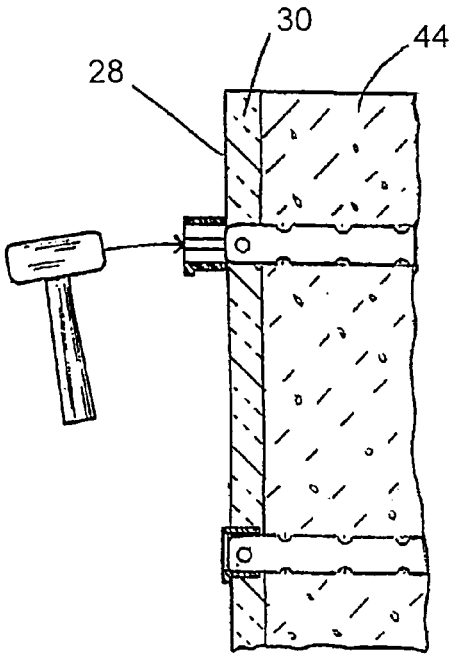
FIG. 9 is a partial cross-sectional side view of a masonry wall with wall ties and insulation.

FIGS. 8, 9, and 10 show one method of using the sheath-retaining device 20 to hold Styrofoam insulation sheets 30 to a pre-cured wall 44.

A poured and cured concrete wall 44 is shown. Prior to use of the device 20, wall forms (most typically sheets of plywood) were located and held in place at their location by the wall ties 42 extending through the cavity between the forms; some at the junction between adjacent forms, some within the body of a particular form. After placement of the forms, a concrete slurry was poured into the cavity. When holding the wall forms, the ties 42 are spaced in an even array, forming vertical rows and horizontal placement lines. Subsequent to setting, the wall forms are removed with the wall ties 42 imbedded within the cured concrete 44 in the form-holding array, leaving the ends of the wall ties 42, which had held the forms in place, protruding from the surface of the cured wall 44. As the wall ties 42 are standard, the ends of each protrude out from the concrete wall 44 a uniform distance. The array facilitates placement of the Styrofoam insulation sheets 30. Insulation sheets 30 have surface dimensions which are approximately the same dimensions as the form, and a sheet depth at least equal to the distance the wall ties 42 extend out from the concrete wall 44. Insulation sheets 30 are placed against the cured wall 44 such that one vertical edge 48 abuts a vertical row of the array of wall ties 42 protruding from the concrete wall 44 and the opposite corresponding vertical edge 48 will abut another vertical row of the array of wall ties 42 with an intervening vertical row of the array of wall ties 42 extending up the middle of the insulation sheet 30. Hand pressure is placed on the exterior surface 28 of the insulation sheet 30 such that the central vertical row of wall ties 42 pierce the sheet 30 to a point where the outermost portion of the free end of the wall tie 42 is nearly flush with the exterior surface of the insulation sheet 30. The sheath-retaining device 20 is positioned such that the front face 24 is nearest insulation sheet 30 and the protruding end of the wall tie 42 is entering the channel 34 at the front port 36. A hammer or mallet 46 is used to strike the back face 26 of the sheath-engaging portion 22 thereby driving the protruding end of the wall tie 42 into the channel 34 toward the back port 38 to a point at which the front face 24 is in contact with the outer surface 28 of the insulation sheet 30 and the wall tie 42 is in snug engagement with the channel walls 40.

FIGS. 8 and 11 show an alternate method of using the sheath-retaining device 20 to hold insulation sheets 30 to a pre-cured concrete wall 44.

A poured and cured concrete wall 44 is shown. In a manner described in the above method embodiment, after the wall forms are removed, the wall ties 42 are imbedded within the cured concrete wall 44 in the form-holding array, leaving the ends of the wall ties 42, which had held the forms in place, protruding from the surface of the cured concrete wall 44. Insulation sheets 30 used in this method have surface dimensions which are approximately the same dimensions as the form, and a sheet depth of a dimension less than the distance the wall ties 42 extend out from the concrete wall 44. Insulation sheets 30 are placed against the cured concrete wall 44 such that one vertical edge 48 abuts a vertical row of the array of wall ties 42 protruding from the concrete 44 and the opposite corresponding vertical edge 48 will abut another vertical row of the array of wall ties 42 with an intervening vertical row of the array of wall ties 42 extending up the middle of the insulation sheet 30. Hand pressure is placed on the exterior surface 28 of the insulation sheet 30 such that the central vertical row wall ties 42 pierce the insulation sheet 30 to a point where the outermost portion of the free end of the wall tie 42 is nearly flush with the exterior surface of the insulation sheet 30. The sheath-retaining device 20 is placed such that the back face 26 is nearest the sheet of insulation 30. The back port 38 is positioned to engage the protruding end of the wall tie 42. A hammer or mallet 46 is used to strike the front port frame 50 or front face 24 in a manner such that the protruding end of the wall tie 42 is driven into snug engagement with the channel 34 and the back face 26 is in contact with the insulation sheet 30.

While the principles of the invention have been shown and described in connection with but a few embodiments, it is to be understood clearly that such embodiments are by way of example and are not limiting.

The invention claimed is:

1. A method for securing a sheathing panel against a surface of a previously poured and cured unitary concrete wall having two outer wall surfaces and at least one wall-tie of rectangular cross-section embedded in the wall and extending therefrom to a distal wall-tie end, comprising:

leaving in place the wall-ties with their extensions beyond the outer wall surface, to provide projections from the wall surface without concrete-puncturing fastener attachment;

pushing the sheathing panel toward the previously-cured wall surface, thereby causing the wall-ties to penetrate through the sheathing panel such that the distal end(s) of the wall-tie(s) are exposed at the outer surface thereof, thereby to puncture and penetrate through the sheathing panel onto the previously-cured wall surface without having added mechanical fasteners to the wall surface;

pressing onto the distal end(s) of each of the wall-tie(s) a press-fit sheathing-retention device which includes a tie-engagement channel portion having a channel with a substantially rectangular-cross-section of a same general shape as the rectangular cross-section of the wall-tie; and urging the tie-engagement channel portion of each sheathing-retention device along the respective wall-tie toward the previously-cured wall surface until the sheathing panel is snugly held against the wall by the press-fit sheathing-retention device(s).

2. The method of claim 1 wherein the press-fit sheathing-retention device includes a panel-retention portion at one end of the tie-engagement channel portion, the panel-retention portion having a sheathing-engaging side and an urging side, and wherein the step of urging includes striking the urging side of the panel-retention portion with a blunt object.

3. The method of claim 2 wherein the cross-section of the substantially rectangular channel varies slightly at positions along the length of the channel.

4. The method of claim 3 wherein the lesser dimensions of the rectangular channel cross-sections vary at positions along the length of the channel.

5. The method of claim 4 wherein the lesser dimensions of the rectangular channel cross-sections are slightly tapered from smaller to larger at positions moving progressively from the panel-retention portion to the opposite end of the channel.

6. The method of claim 1 wherein the press-fit sheathing-retention device includes a panel-retention portion at one end of the tie-engagement channel portion, and wherein the step of pressing the tie-engagement channel portion onto the distal end of the respective wall-tie includes inserting the wall-tie into the end of the tie-engagement channel portion having the panel-retention portion.

7. The method of claim 1 wherein the press-fit sheathing-retention device includes a panel-retention portion at one end of the tie-engagement channel portion, and wherein the step of pressing the tie-engagement channel portion onto the distal end of the wall-tie includes inserting the wall-tie into the end of the tie-engagement channel portion that is opposite the end of the tie-engagement channel portion that has the panel-retention portion.

8. In a method for securing a sheathing panel against a concrete wall having a wall surface and at least one wall-tie of rectangular cross-section embedded in the wall and extending from the wall surface to a distal wall-tie end by using press-fit sheathing retention devices engaged with the wall-ties, the improvement wherein:

before the sheathing is placed against the concrete wall and the sheathing retention devices engaged with the wall-ties, the concrete wall is poured and cured;

leaving in place the wall-ties with their extensions beyond the outer wall surface, to provide projections from the wall surface without concrete-puncturing fastener attachment;

pushing the sheathing panel toward the previously-cured wall surface, thereby causing the wall-ties to penetrate through the sheathing panel such that the distal end(s) of the wall-tie(s) are exposed at the outer surface thereof, thereby to puncture and penetrate through the sheathing panel onto the previously-cured wall surface without having added mechanical fasteners to the wall surface;

pressing onto the distal end of each wall-tie one of the press-fit sheathing-retention devices, each sheathing retention device including a tie-engagement channel portion having a channel with a substantially rectangular-cross-section of a same general shape as the rectangular cross-section of the wall-tie; and urging the tie-engagement channel portion of each sheathing-retention device along the respective wall-tie toward the poured and cured wall surface until the sheathing panel is snugly held against the wall by the press-fit sheathing-retention device(s).

9. The method of claim 8 wherein the press-fit sheathing-retention device includes a panel-retention portion at one end of the tie-engagement channel portion, the panel-retention portion having a sheathing-engaging side and an urging side, and wherein the step of urging includes striking the urging side of the panel-retention portion with a blunt object.

10. The method of claim 9 wherein the cross-section of the substantially rectangular channel varies slightly at positions along the length of the channel.

11. The method of claim 10 wherein the lesser dimensions of the rectangular channel cross-sections vary at positions along the length of the channel.

12. The method of claim 10 wherein the lesser dimensions of the rectangular channel cross-sections are slightly tapered from smaller to larger at positions moving progressively from the panel-retention portion to the opposite end of the channel.

13. The method of claim 8 wherein the press-fit sheathing-retention device includes a panel-retention portion at one end of the tie-engagement channel portion, and wherein the step of pressing the tie-engagement channel portion onto the distal end of the respective wall-tie includes inserting the wall-tie into the end of the tie-engagement channel portion having the panel-retention portion.

14. The method of claim 8 wherein the press-fit sheathing-retention device includes a panel-retention portion at one end of the tie-engagement channel portion, and wherein the step of pressing the tie-engagement channel portion onto the distal end of the wall-tie includes inserting the wall-tie into the end of the tie-engagement channel portion that is opposite the end of the tie-engagement channel portion that has the panel-retention portion.

* * * * *